United States Patent [19]

Smith

[11] 4,110,928

[45] Sep. 5, 1978

[54] SAFETY DEVICE FOR PREVENTING UNAUTHORIZED ACTUATION OF A TOUCH-ACTUATED MECHANISM

[76] Inventor: Joseph E. Smith, 170 Locksumart Way #23, Sunnyvale, Calif. 94087

[21] Appl. No.: 781,035

[22] Filed: Mar. 24, 1977

Related U.S. Application Data

[63] Continuation-in-part of Ser. No. 670,937, Mar. 26, 1976, Pat. No. 4,067,132, which is a continuation-in-part of Ser. No. 530,891, Dec. 9, 1974, Pat. No. 3,978,604.

[51] Int. Cl.[2] ..... F41C 17/00

[52] U.S. Cl. ..... 42/66; 42/1 MH

[58] Field of Search ..... 42/70 R, 70 E, 70 F, 42/66, 1 MH, 67

[56] References Cited

U.S. PATENT DOCUMENTS

| | | | |
|---|---|---|---|
| 1,122,635 | 12/1914 | Pomeroy | 42/66 |
| 3,978,604 | 9/1976 | Smith | 42/70 E |

*Primary Examiner*—Charles T. Jordan

*Attorney, Agent, or Firm*—Richard Alan Brown

[57] ABSTRACT

Trigger or touch-actuated or screw-cap actuated safety device for trigger or touch-actuated or screw-cap actuated mechanisms is provided having a pivotally mounted magnetically responsive bar positioned on the inside of the handle on the rear of the trigger. When the bar is oriented centrally, sufficient movement of the trigger is inhibited to prevent actuation of the device. The bar may be mounted in a non-magnetizable casing. The user of the device, by wearing a magnetic ring, displaces the bar from its central orientation and allows for sufficient movement of the trigger for actuation. The present invention may also be employed to selectively inhibit operation of touch-actuated devices.

4 Claims, 19 Drawing Figures

FIG _ 1
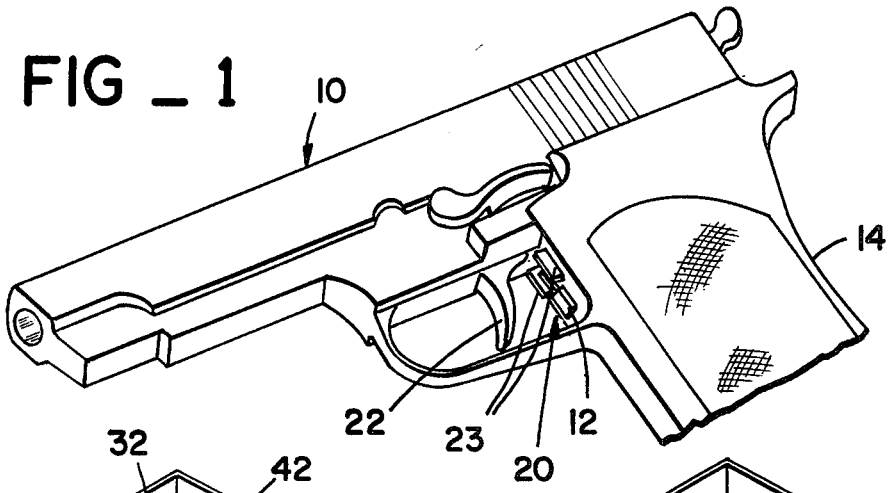
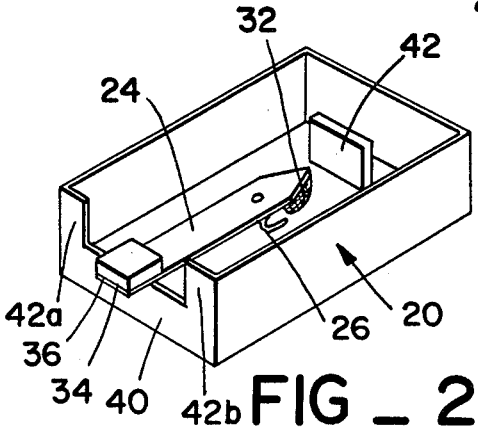
FIG _ 2
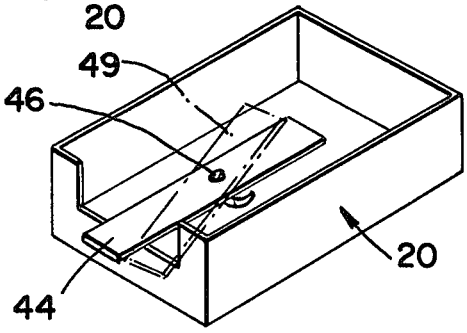
FIG _ 5
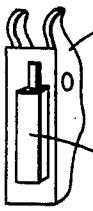
FIG _ 3
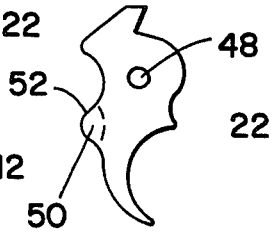
FIG _ 4
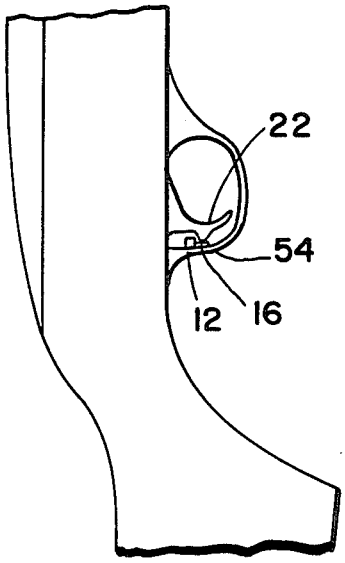
FIG _ 8
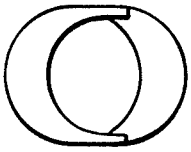
FIG _ 6
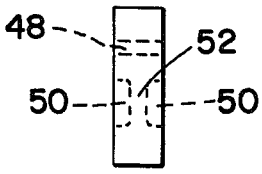
FIG _ 7

SAFETY DEVICE FOR PREVENTING UNAUTHORIZED ACTUATION OF A TOUCH-ACTUATED MECHANISM

BACKGROUND OF THE INVENTION

This is a continuation-in-part of the application, Ser. No. 670,937, filed Mar. 26, 1976, now U.S. Pat. No. 4,067,132, which is a continuation-in-part of the application Ser. No. 530,891, filed Dec. 9, 1974, now U.S. Pat. No. 3,978,604.

FIELD OF THE INVENTION

There is a well-recognized need to prevent, for example, the undesired firing of a firearm. Many accidental shootings occur when the weapon is fired, despite the fact that the holder does not pull the trigger. Also, of concern with law enforcement officers is the loss of their weapon during an investigation or altercation when the law enforcement officer is disarmed and threatened with his own weapon.

A simple device is desirable which would prevent other than the owner from firing a firearm or any other touch-operable device. Also, it would be useful to have a protective mechanism which would prevent accidental firing of a firearm or any unauthorized use of a touch-operable device.

BRIEF DESCRIPTION OF THE PRIOR ART

A number of sophisticated protective devices have been provided for firearms or trigger-actuated devices. The following U.S. patents describe such devices: U.S. Pat. Nos. 2,195,693; 2,401,482; 439,055; 2,979,845; and 3,031,787. Also of interest are U.S. Pat. Nos. 3,571,544; 3,944,762; 3,801,767; 2,548,581; and 3,493,902, which generally disclose magnetic safety or switching mechanisms.

SUMMARY OF THE INVENTION

A simple safety mechanism for trigger or touch-operable devices is provided employing a magnetically responsive bar pivotally mounted adjacent the back of the trigger or in the housing of the device. Such devices may comprise, for example, a gun, a revolver, a semi-automatic handgun, shotgun, rifle, tear gas pressurized can, or the like. The bar is preferably balanced about the pivot point, so as to require the least amount of bias force to maintain a neutral position whereby it inhibits the displacement of a movable part of the device, such as, for example, the hammer of a weapon or touch button of a pressurized container, a sufficient distance for firing or actuating the discharge of a propellant, or the removal of a bottle cap. It is noted, however, that the bar need not necessarily be balanced about the pivot point since the bar may be held in any position by a biasing means so as to inhibit displacement of the movable part. In a specific embodiment, a magnet, forming the biasing means, is positioned to aid a non-magnetic bar to maintain the inhibiting position, while a magnetic bar may be centered by the steel trigger or steel in the device housing. The user of the device wears a magnetic ring, which either attracts or repels the bar and moves it out of confrontation, so as to allow for the actuation of the trigger-actuated or touch-operable device.

In accordance with the present invention, an apparatus is provided for selectively blocking movement of a part of a device employing the apparatus which comprises: a magnetically actuable member pivotally mounted with respect to the part of the device employing the apparatus; stop means for preventing the member from pivoting beyond a predetermined arc; and, bias means for maintaining the member in a position of the arc for preventing the actuation of the part for effectuating the operation of the device.

BRIEF DESCRIPTION OF THE DRAWINGS

FIG. 1 is a fragmentary perspective view of an automatic pistol with the safety device attached to the handle;

FIG. 2 is a perspective view of one embodiment of the safety device;

FIG. 3 is a perspective view of the trigger with the safety device mounted on its rear;

FIG. 4 is a slide elevation view of a modified trigger;

FIG. 5 is a perspective view of an alternate embodiment of the safety device;

FIG. 6 is a front elevation view of a magnetic ring;

FIG. 7 is a rear elevation view of the trigger;

FIG. 8 is a side elevation view of a rifle with the safety device attached to the trigger protector;

DESCRIPTION OF THE SPECIFIC EMBODIMENTS

Figure 9:
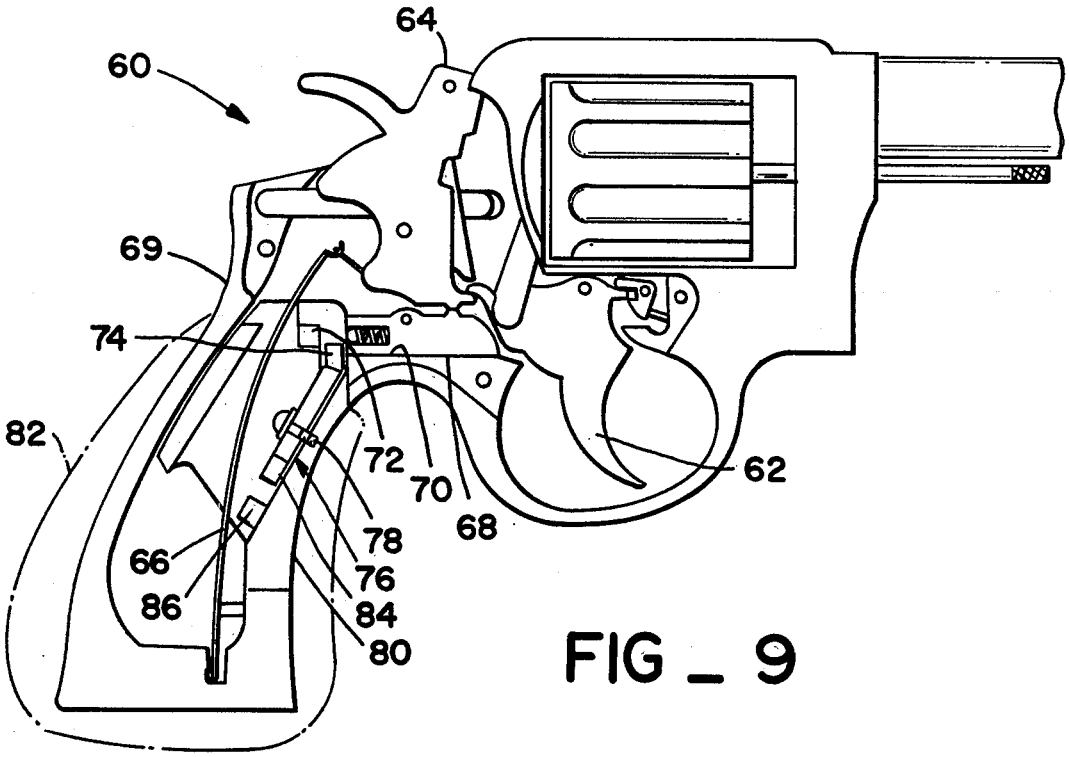
FIG. 9 is a side elevation view of an embodiment of a revolver incorporating the safety device.

A simple efficient device is provided as a safety mechanism to prevent accidental firing of a firearm or any unauthorized use of a trigger-actuated device. The subject device is operable by both left and right-handed users and is not readily interfered with by an unauthorized user. The device is relatively foolproof in requiring the user to have a magnet before the trigger can be moved to actuate the firing mechanism. In one embodiment the subject device fits into the space or well between the trigger and the handle or butt of firearms. Furthermore, the space is kept sufficiently small, so that the device cannot be easily manually manipulated. In other embodiments the subject device is totally enclosed by the handle grip. In addition, the subject device is reliable and remains operative during normal cleaning operations for pistols, such as ultrasonic cleaning.

The subject device comprises a pivotally mounted magnetic pin or bar, which may be balanced about the pivot. The bar is positioned either on the back of the trigger or in the handle or butt near the roof of the well defined by the trigger, stock and handle, so as to be directed toward the confronting surface. Stops are provided to prevent the bar from swinging too far from the midpoint or desired plane. The bar is retained substantially in a place through the long axis of the barrel dividing the firearm in half.

Depending upon the material of the firearm to which the device is attached, the swivel bar will be a magnetic or a non-magnetic material. In embodiments where the bar is disposed to block trigger movement, the firearm handle or butt (hereinafter "handle" will intend handle of a pistol and stock of the rifle behind the trigger) would preferably be of a non-magnetic material and the trigger would be magnetically attractable. In this manner, a magnetic bar would be centered by its attraction to the trigger and held in that position until attracted or repulsed by a magnet. Where the bar is mounted onto a magnetically attractable material, the bar will be a non-magnetic material. A weak magnet may be employed adjacent the end opposite the confronting end of the bar, so as to align the bar in the central position for blocking the trigger. Conveniently, the bar may be mounted in a non-ferruginous housing, e.g. metal or plastic, which is mounted on or in the handle or butt of the firearm, so that only a small portion of the bar extends from the housing.

The swivel or pivotal bar may similarly be mounted within the handle or butt of the firearm in a neutral position blocking translation of a slide or a rod, coupled to either the trigger or to the hammer, thereby inhibiting the hammer from releasing to strike a charge or cartridge disposed in the chamber of the weapon. In one embodiment, movement of the trigger and thus of the hammer may be inhibited, in a further embodiment, the hammer alone may be inhibited from striking the firing pin. In another embodiment, the swivel or pivotal bar may be disposed within the handle or butt of the firearm in a neutral position blocking rotation of a cylinder of a revolver, which, in turn, inhibits actuation of the trigger of the firearm. In yet another embodiment, the pivotal bar may be disposed within a pressure-operable container in a conflicting position blocking movement of the touch-operable button of the container thereby inhibiting the button from being depressed so as to force the propellent in the container to be discharged.

For further understanding of the invention, the figures will now be considered.

In FIG. 1 a pistol 10 is shown with the safety device 12 mounted on the pistol handle 14. The swivel bar 16 extends from the nonferruginous housing 20 in confronting relationship with trigger 22. Protective walls 23 may optionally be provided on the sides of the housing 20 adjacent the swivel bar 16.

Two different embodiments of the safety device are depicted in FIGS. 2 and 5. In FIG. 2, a non-magnetic bar 24 is pivotally mounted on post 26, which is affixed to the housing floor. The bar 24 has weight 32, ferruginous and pointed at one end, which serves to balance the bar and keep the bar in the center position of the rear magnet 42. At the opposite end 34 of the bar 24 is a ferruginous block 36, which is attracted to magnetic material, respectively. The front wall 40 of the housing 20 has an aperture with side walls **42*a* and 42*b*, which serve as stops to prevent bar 24 from moving too far to either side. In this way, the bar 24 remains centered in confronting relationship with the trigger 22 (FIG. 1**).

The housing 20 is conveniently formed of metal or plastic, and preferably formed of a non-magnetically attractable material. As a result, the housing does not interfere with the movement of the bar 24 or create any drag on the bar 24.

In FIG. 5, an alternate embodiment has housing 20 and magnetic bar 44. Magnetic bar 44 is pivotally mounted on post 46 at its center of gravity, so as to be balanced about the pivot point. The bar is shown in the safety position. The bar 49 in phantom is shown in the firing or safety off position.

Figure 11:
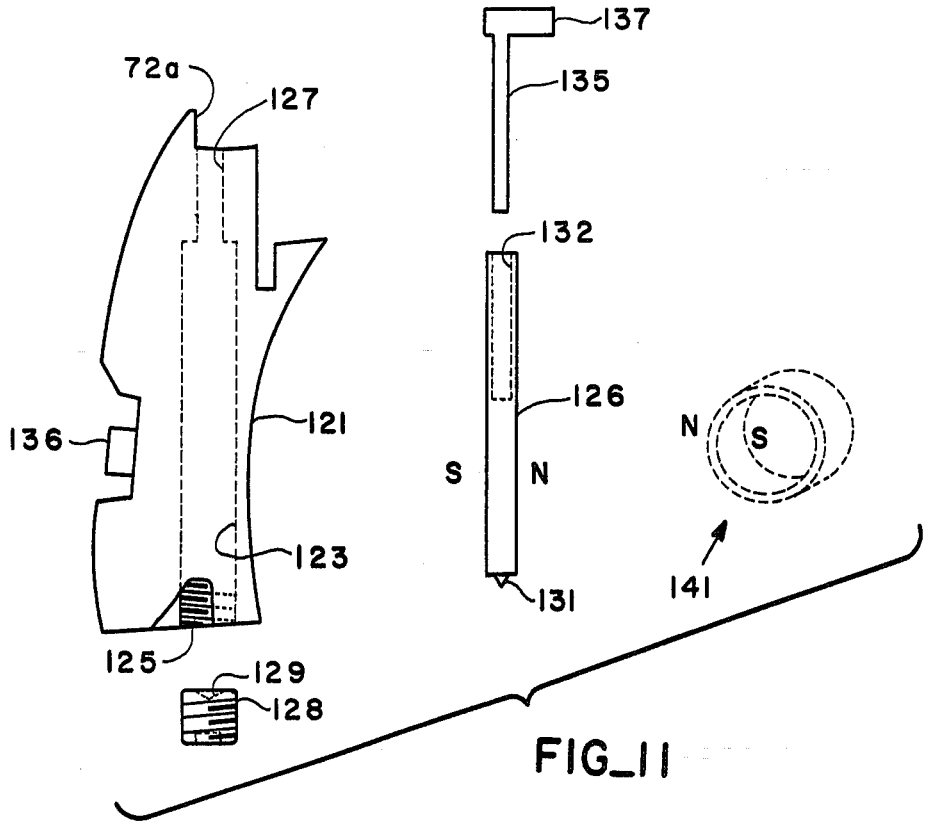
FIG. 11 is an exploded view of the mechanism of another embodiment of a revolver incorporating the present invention.

When the safety device 12 is mounted on the handle, the trigger 22, as depicted in FIGS. 4 and 7, is notched on each side to provide indents 50 and leave a center projection 52, which is in confronting relationship with the swivel bar 16. The portion of the trigger 22, which is notched, is a projection of the trigger behind and below the pivot pin sleeve 48. Yet another embodiment of the present invention is illustrated in FIG. 11, which will be described in greater detail hereinbelow.

In FIG. 3, the safety device 12 is mounted onto trigger 22. When mounted onto trigger 22, the swivel bar 16 will confront the handle. It is pointed out that swivel bar 16 corresponds to the non-magnetic bar 24 as shown in FIG. 2 and the magnetic bar 44 shown in FIG. 5. Portions of the handle may be formed of non-magnetic material such as aluminum so as not to interfere with the magnetic forces on the swivel bar 16. Furthermore, portions of the handle may be notched, and may be comparable to the notching of the trigger, to allow for the retraction of the trigger without the swivel bar encountering the handle.

In FIG. 6 is depicted a magnetic ring which may be worn on the trigger finger of the user of the firearm wherein the safety device is provided adjacent to the trigger. In embodiments explained hereinafter the ring may be worn on, for example, the ring finger. When the trigger finger is placed on the trigger, the magnetic ring attracts or repels the swivel bar 16 moving it out of confronting relationship with the projection present on the handle or trigger. The trigger is then free to be retracted for firing.

The size of the well between the trigger and handle will vary depending on the nature of the firearm. In some instances, it will be necessary or desirable to hollow out a portion of the handle for insertion of the safety device. The amount of the upper portion of the handle that must be removed can be readily determined in accordance with the dimensions of the various parts involved. The particular angle at which the swivel bar confronts the trigger rear is also a matter of accommodation. For example, the safety device 12 may be mounted with the trigger blocking swivel bar 16 oriented to point downwardly, that is, away from the firing chamber.

Where a magnetically non-attractable handle is employed, a magnetic swivel bar can be directly incorporated into the firearm handle at the time of manufacture, while any non-magnetic material may be used for the handle with a non-magnetic swivel bar. A housing for the swivel bar could be provided, molded integrally with the handle or stock, and the swivel bar pivotally mounted in the housing. The housing would serve as the stop.

In FIG. 8 is depicted the safety device 12 mounted onto the trigger protector 54 of a rifle. In its rest position the swivel bar 16 blocks the movement of the trigger 22 preventing the weapon from being fired. The orientation of the swivel bar 16, which may for example, point either toward or away from the barrel, is a matter of design choice.

In FIG. 9 a further embodiment of the invention is illustrated, herein incorporated in a revolver 60 having trigger 62 and hammer 64 operated by a leaf spring 66. A bar rebound slide 68 within the revolver frame 69 is normally able to slide along a tract 70 in response to the movement of the trigger 62. Full movement of the slide typically releases the hammer 64 discharging the revolver 60. The movement of the slide 68 will be inhibited by a peg or bar interposed between a backstop 72 and the slide 68. Thus, full movement of the slide 68 is inhibited, preventing release of the hammer 64, thereby preventing undesired discharge of the firearm.

The safety restrictor 74 may be mounted in a number of ways to a magnetically actuable safety device. For example, in FIG. 9, the restrictor 74 is mounted on one end of a swivel bar 76 centrally balanced on a pivot pin 78. The pivot pin 78 is mounted to a wall of a magnetically nonattractable housing 80 such as aluminum. The swivel bar may be mounted in the central vertical plane of the revolver so that the safety restrictor 74 may move across the path of the slide 68. For example, in FIG. 9, the swivel bar 76 is shown mounted to the pin 78 mounted to the front wall of the handle grip housing 80. The housing 80 may be incorporated into the revolver frame 69 and covered by the stock 82 (shown in phantom). In this position the housing 80 forms a portion of the frame 69 adjacent the position where a user would normally place his or her fingers when holding the revolver.

The swivel bar 76 includes a polarized magnet 84 at the end opposite the restrictor 74 and adjacent to the margin of the frame 69. The swivel bar 76 may, for example, comprise a copper jacket having a nonferruginous peg forming the restrictor 74 at one end and a permanent magnet 84 at the opposite end. The axis for the swivel bar 76 may be located at or near the center of the poles of the magnet 84.

In a neutral or safety rest position, the swivel arm 76 is biased to block the slide 68 with the restrictor 74. Biasing force is provided by fixed magnetically attractable means 86 positioned to confront and attract the swivel arm magnetic means 84 adjacent the desired neutral pivotal orientation of the end of the swivel bar 76. The fixed magnetic means 86 may be either a permanent magnet attractive of the magnet 84 or a mass of ferruginous material such as steel.

In order to release the safety device, putting the revolver in a condition for firing, the user, wearing an appropriate magnetic ring (not shown) on, for example, the third finger (not shown) merely grips the handle stock 82 to bring the ring in proximity to the magnet 84 to either side or confronting the central plane of the revolver. The magnetic forces are of sufficient magnitude between the ring and the magnet 84 at one end of the swivel bar 76 causing it to pivotally displace, moving the restrictor 74 at the opposite end from the position normally blocking movement of the slide 68 to a position permitting unrestricted slide and trigger movement.

The relative magnetic polarities of the swivel bar magnet 84 and the confronting ring magnet are preferably selected to repel one another, since it has been found that repelling poles in these configurations create the greatest likelihood that the swivel bar 76 will be adequately displaced, even where the ring exerts nearly perpendicular force.

Figure 10:
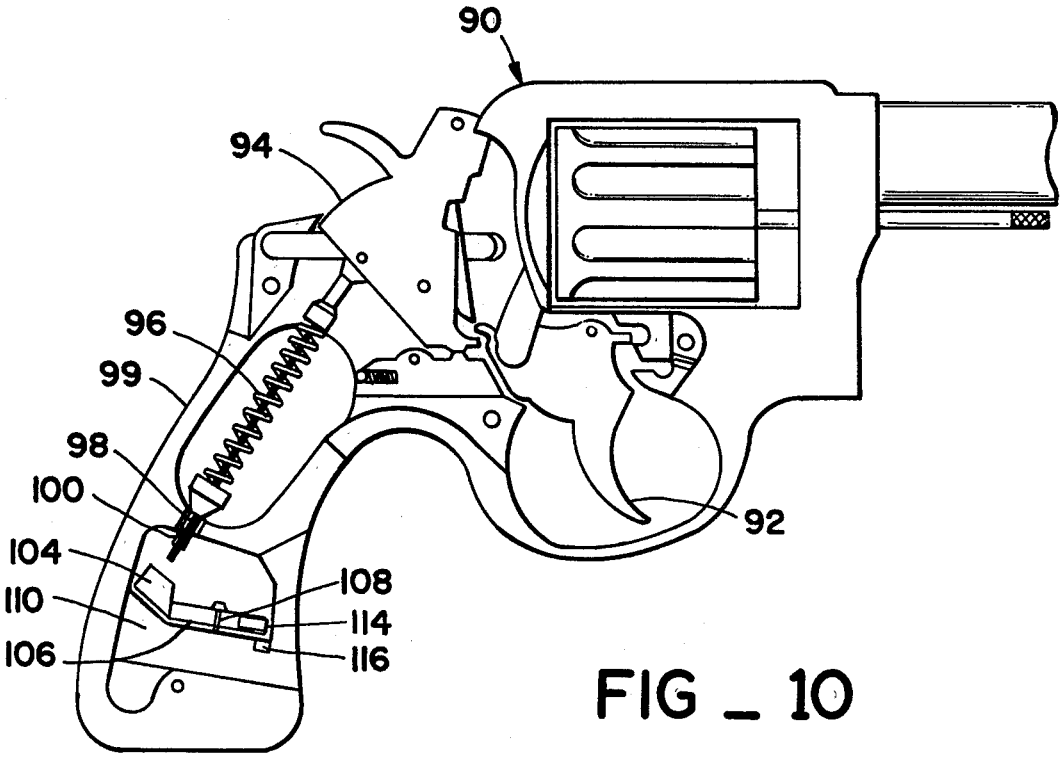
FIG. 10 is a side elevation view of a further embodiment of a revolver incorporating the safety device.

In FIG. 10 the invention is incorporated in a revolver 90 having a trigger 92 and hammer 94 operated by a compression spring 96. A shaft or rod 98 within the revolver handle frame 99 is biased by the spring 96 against the hammer 94 and is slidable in a track 100 directing rod movement approximately along the maximum length of the handle frame 99 in response to hammer rotation. When the restrictor 104 is in the confronting position the hammer 94 cannot be hand-cocked, and the trigger 92 cannot displace the hammer 94 sufficiently to release the hammer 94 to fire the gun.

A safety restrictor 104 is movable on one end of a swivel bar 106 which is balanced on a pivot pin 108, and is mounted to a magnetically non-attractable housing 110 incorporated into the handle frame 99. In this embodiment, the pivot pin 108 is mounted in the central vertical plane of the revolver and the swivel bar 106 is oriented to displace perpendicularly side to side across the path of the rod 98. On the end of the swivel bar 106 opposite the restrictor 104 and adjacent an edge of the frame 99, a permanent polarized magnet 114 may be attached. A bias magnet 116 or magnetically attractable material may be fixedly mounted to or in the housing 110 in a position to attract the swivel bar magnet 114 so that the swivel arm 106 biases the restrictor 104 to a position blocking the shaft or rod 98. For example, the bias magnet 116 may be mounted directly below the neutral position of the swivel bar magnet 114. Alternatively, a hairspring or the like may be employed to maintain the restrictor 104 in a blocking position.

In operation, the restrictor 104 is normally biased to a position blocking the translation of the rod 98 coupled to the hammer 94, thereby preventing the hammer from maximum rotational movement and spring release. Thus, the hammer can neither be hand-cocked for single action firing nor trigger-released as in double action firing. To release the safety device and allow the hammer to release and discharge the firearm, a magnetic ring is typically worn on the ring finger of the user gripping the firearm handle to bring it into proximity with the magnetic end of the swivel bar 106 nearest the front side of the handle. The magnetic forces, preferably repulsion between the magnetic ring and the magnet 114, cause the swivel bar to rotate, unblocking the free movement of the rod 98. The trigger may then be fully retracted, or the hammer may be cocked, so the firearm can be discharged. Thus, the term "dischargemovement" as used herein means any movement of the hammer, whether forward or backward, for the purpose of firing the weapon.

The safety device has been employed with a Smith & Wesson Automatic Model 59, a Smith & Wesson Revolver Model 10, which utilizes a leaf spring (FIG. 9) or a Smith & Wesson Revolver 36, which utilizes a coil or compression spring. In the automatic, the safety device was quite small with its largest dimension a fraction of an inch. The housing may be from about 0.2 to 0.4 inch in width and about 0.3 to 0.6 inch in length with the bar about 0.4 to 0.6 inch in length, and the swivel bar extending from about 0.2 to 0.4 inch from the housing. The bar should be of a strong material, but relatively light and be pivotally mounted with a minimum of drag. The bar can be as little as about 25 mils in thickness, although somewhat greater thicknesses are preferred. In the Model 10 and the Model 36, the safety device is conveniently incorporated into the handle.

The magnetic safety device may also be configured to prevent the release of a cocked hammer to strike a firing pin, or to prevent the release of a cocked hammer which would discharge the firearm. For example, a rod may be interposed between the firing pin and the hammer while the safety device is in a neutral or safety "on" condition. Alternatively, on those weapons where the firing pin is incorporated within the hammer, the rod may be interposed between the hammer and the cartridge in the firing chamber of the weapon. This has the advantage of preventing discharge of a cocked firearm, without the magnetic ring, even though trigger actuation is not blocked. This is particularly useful in firearms designed for single action firing, where the hammer may be cocked independent of the trigger.

Referring now to FIG. 11, an exploded view of another embodiment of the present invention is illustrated. This embodiment is inherent in a modified version of the embodiment illustrated in FIG. 9 and described hereinabove. A supporting body 121 of a magnetically non-attractable material has formed therein a tubular-shaped channel 123 having a threaded end 125 and having a second end 127 with a reduced diameter. The shape of the body 121 is such that it will readily fit into the handle grip frame of a gun or revolver.

A pivoting or rotating member 126 of a magnetically-attractable material is shown in FIG. 11 adjacent to the body 121. The member 126 fits into the channel opening 123 of the body 121 and is retained therein by a threaded screw 128 adpated to engage the threaded end 125 of the body 121. The member 126 is preferably magnetized and may, for example, be magnetized with a polarity as illustrated in FIG. 11. Alternatively, member 126 may be formed of any suitable material having a magnet contained therein and similarly polarized as shown in FIG. 11. In accordance with a specific embodiment, one end of the rotating member 126 has a point, or conical-shaped end 131 formed to engage a valley or bearing dimple 129 of the threaded screw 128. The opposite end of the member 126 also has a channel opening 132 formed therein. A restraining member 135 having confronting typehead restrictor 137 on one end thereof is formed so as to be received by the channel 132 of the member 126. The member 135 frictionally engages or is permanently secured into the channel 132 of the member 126, and in particular, passes through the channel 127 of the body 121. Thus, the combination of the body 121, the member 126, the retaining screw 128 and the member 135 forms an assembly comprising the safety-device mechanism of this embodiment of the present invention. A biasing means 136 is provided near the channel 123 so as to maintain a preferred orientation of the member's 126 and 135 when disposed in the channel opening 123 of the body 121. For example, biasing means 136, in the preferred embodiment, may comprise a magnet which is polarized so as to attract an edge of the member 126 to secure the confronting head restrictor 137 of member 135 in a select orientation. Alternatively, a spring (not shown) may be used for the biasing means 136. Biasing means 136 may be located anywhere near the member 126.

With the mechanism assembled as above described, and as illustrated in FIG. 11, if a magnet such as magnet 141 (shown in phantom) is brought into proximity with the body 121, the member 126 will twist, rotate, or pivot on the point 131 of the member 126. Accordingly, the confronting head restrictor 137 of the member 135 will align in a different orientation than that without the presence of the magnet 141. If magnet 141 is subsequently removed from proximity with the body 121, the bias means 136 will return the member 126 to the preferred conflicting relationship. An extended part **72*a* of body 121 functions to prevent the restrictor 137 of member 135 from pivoting beyond a predetermined arc. The magnet 141 is shown in FIG. 11 in a repelling configuration with the magnetic polarization of the member 126. However, it is noted that an attracting magnetic mode may be employed to change the orientation of the confronting head 137 of the member 135**.

Figure 12:
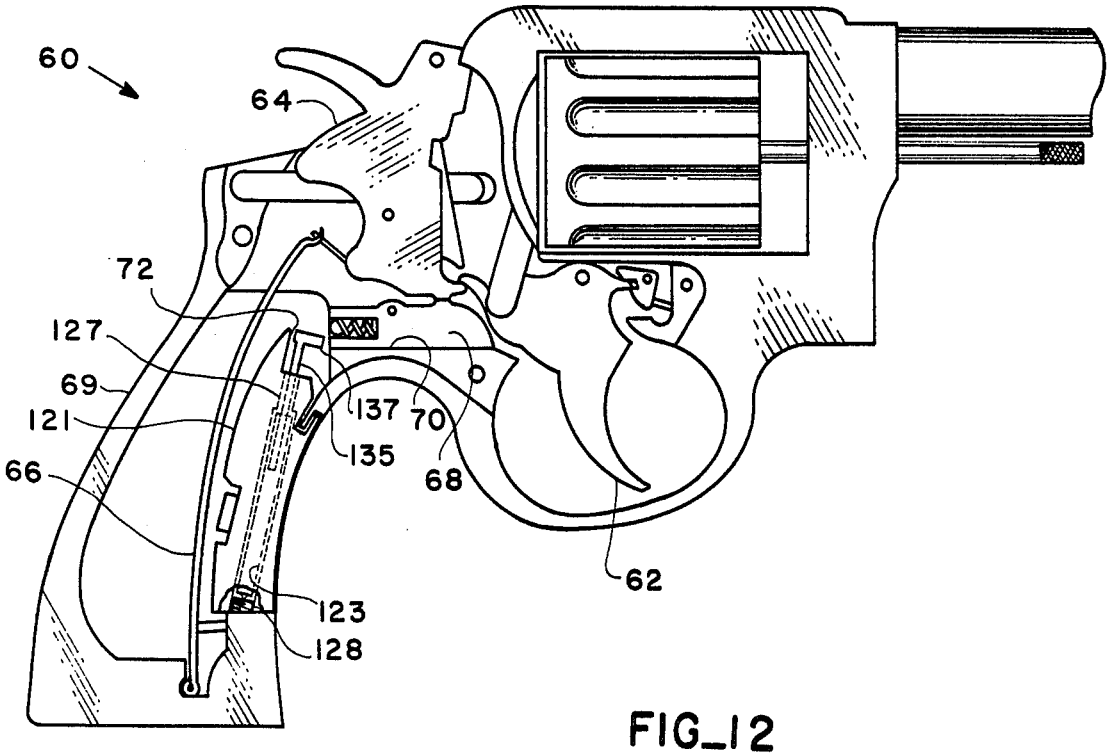
FIGS. 12 and 13 are side elevation views of additional embodiments of a revolver incorporating the safety device of the present invention.

In FIG. 12, the embodiment described in FIG. 11 is illustrated herein with the body 121 incorporated in a revolver 60 having a trigger 62 and hammer 64 operated by a leaf spring 66. A rebound bar slide 68 within the revolver frame 69 is normally able to slide along a tract 70 in response to the movement of the trigger 62, or by cocking the hammer. Full movement of the slide typically releases the hammer 64 discharging the revolver 60. However, the confronting head restrictor 137 of the member 135 is interposed in the path of the slide 68 to thereby inhibit movement of the slide, preventing cocking action of the hammer 64, thus preventing discharge of the firearm.

The safety restrictor 137 may be oriented in a number of ways to accomplish the result of inhibiting movement of the slide member 68. However, it is preferable to orient the confronting head restrictor 137 in a direction as illustrated for better strength in inhibiting movement of the slide 68. When a magnetic force is brought in proximity to a handle grip frame of the weapon 69, the confronting head restrictor 137 is rotated away from the path of the slide 68, thus permitting movement of the slide 68 along the track 70 back toward the backstop 72, thereby permitting full movement of the trigger 62 and hammer 64. If the magnetic force is subsequently removed from proximity with the body 121, the bias means described in the discussion of FIG. 11 will cause the restrictor 137 to return to the preferred conflicting relationship. The backstop 72 functions to prevent the restrictor 137 of member 135 from pivoting beyond a predetermined arc.

Figure 13:
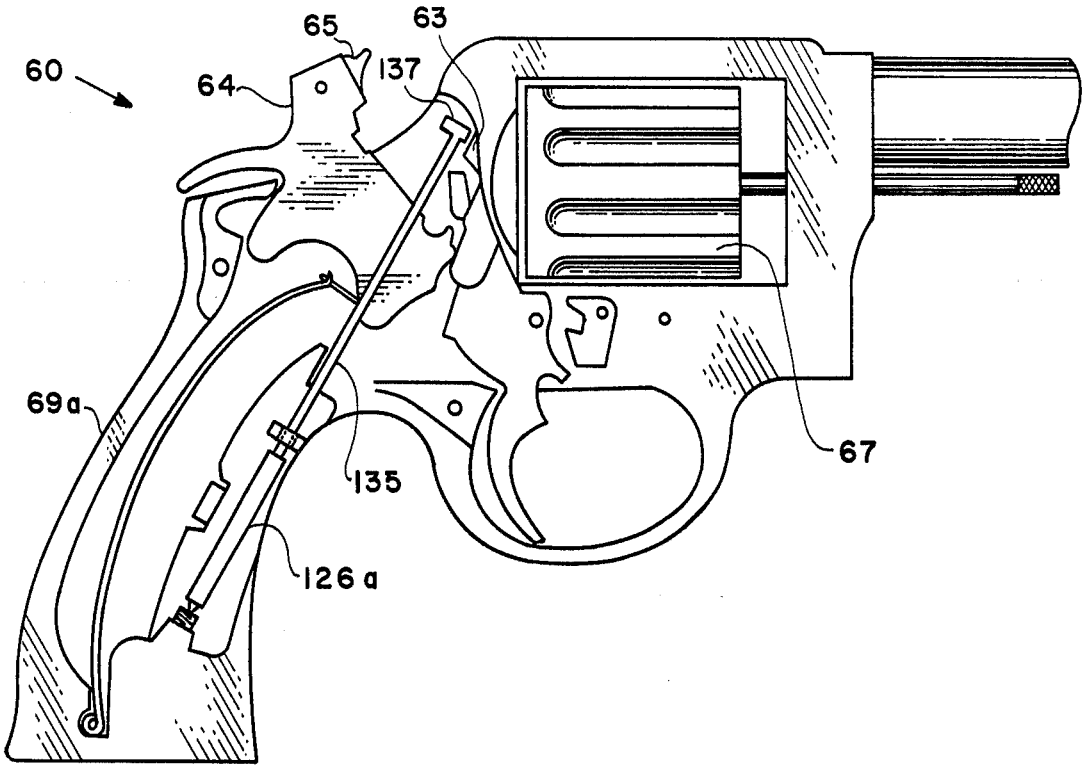

Referring now to FIG. 13, a modified version of the embodiment illustrated in FIG. 11 is shown as being incorporated in a revolver 60. The pivoting or rotating member **126*a*, constructed of a magnetically attractable material, is mounted in the handle grip frame 69*a* of the revolver 60. However, in this embodiment the member 135 is extended in length so as to locate the confronting head restrictor 137 in conflicting relationship between the hammer 64 and a hammer backstop 63. Also, the backstop 63 normally has a flat surface that functions to prevent the restrictor 137 of member 135 from pivoting beyond a predetermined arc. Thus, with the confronting head restrictor 137 oriented in the direction as shown in FIG. 13, full movement of the hammer 64 is impeded thereby preventing a firing pin 65 on the hammer 64 from making contact with the active end of a cartridge (not shown) in a chamber of a cylinder 67 of the revolver 60. When, for example, an external magnet is brought into proximity with the member 126*a* the magnetic forces thereof will cause the confronting head 137 to rotate out of conflicting relationship with the hammer 64, thereby allowing the firing pin 65 to strike the cartridge in the weapon 60. If the external magnet is subsequently removed from proximity with the member 126*a*, the bias means described in the discussion of FIG. 11** will cause the restrictor to return to the preferred conflicting relationship. However, it is noted the firing pin need not be attached to the hammer, but the firing pin may be contained within the weapon.

Figure 14:
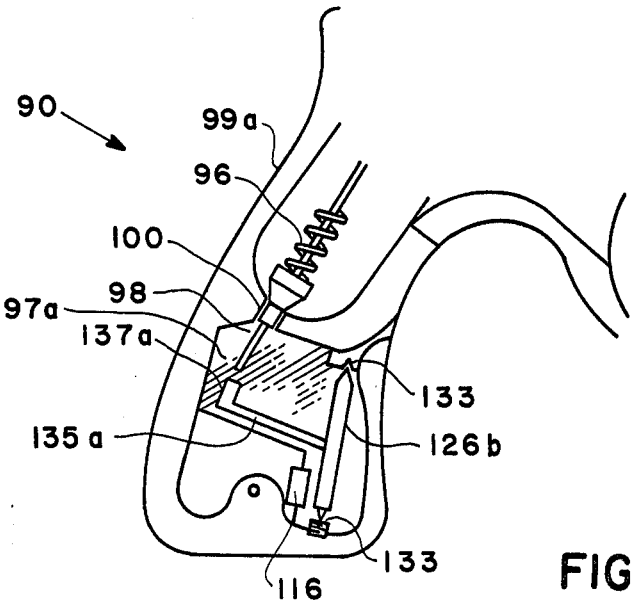
FIGS. 14 through 16 are side elevational views of additional embodiments incorporating the safety device of the present invention illustrating only a portion of the revolver shown in FIG. 9.

Referring now to FIG. 14, yet another modified version of the embodiment illustrated in FIG. 11 and described hereinabove is shown. In this version the safety device is mounted in a handle grip frame 99*a* of a weapon 90. Only a portion of the weapon 90 is illustrated in this figure since such a weapon has been illustrated in FIG. 10 and described in detail hereinabove. A pivoting or rotating member 126*b* is disposed for rotation upon bearings 133 communicating with ends of the member 126*b*. An extension member 135*a* is attached to member 126*b* and includes a confronting head restrictor 137*a* on one end thereof. The confronting head restrictor 137*a* is disposed in confronting relationship with one end of a shaft or rod 98 biased by a spring 96 against the hammer (not shown) of the weapon 90. Biasing means 116 is located in proximity to the member 126*b* so as to maintain the confronting head restrictor 137*a* in a confronting relationship with the shaft or rod 98. A side cover 97*a* of the handle grip frame 99*a* and the other side cover which has been removed to illustrate the safety device of the invention function to prevent the member 135*a* from pivoting beyond a predetermined arc.

When a magnetic force is brought into proximity with the member 126*b*, this member pivots about the central axis thereby moving the confronting head restrictor 137*a* out of conflicting relationship with the shaft or rod 98. Thus, the shaft or rod 98 is slidable in a tract 100 directing rod movement approximately along the maximum length of the handle frame 99*a* in response to hammer (not shown) rotation. Accordingly, the weapon 90 can be fired when a magnetic force is in proximity with the member 126*b*. If the magnetic force is subsequently removed from proximity with the member 126*b*, the biasing means 116 will return the restrictor 137*a* to the preferred conflicting relationship and the weapon cannot be fired.

Figure 15:
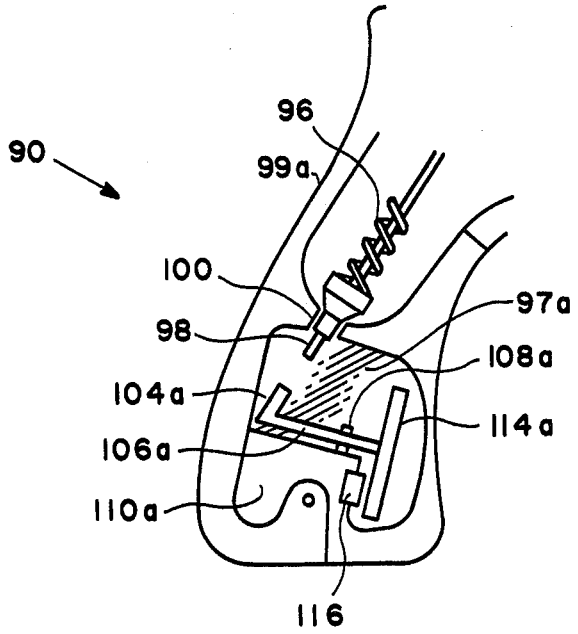

Referring now to FIG. 15, a modified version of the embodiment illustrated in FIG. 10 and described hereinabove is shown. Only a portion of a revolver 90 is shown since the revolver is substantially identical with that as shown in FIG. 10. A shaft or rod 98 within the handle grip frame 99*a* is biased by a compression spring 96 against the hammer (not shown) and is slidable in a track 100 directing rod movement approximately along the maximum length of handle frame 99*a* in response to hammer rotation. A restrictor 104*a* is disposed in conflicting relationship with an end of the rod or shaft 98, so as to prevent cocking of the hammer, which prevents the trigger (not shown) from displacing the hammer sufficiently to release the hammer.

The safety restrictor 104*a* is mounted on one end of swivel bar member 106*a*, which is pivoted about a pivot pin 108*a* and is mounted to a non-magnetically attractable housing 110*a* incorporated into the revolver frame 99*a*. The swivel bar 106*a* is oriented to displace side-to-side across the path of the rod 98. A magnet 114*a* is attached on the end of the swivel bar 106*a* opposite the restrictor 104*a*. A magnet 116 may be used for biasing and may be fixedly mounted to or in the housing 110*a* in a position to attract the swivel bar magnet 114*a* so that the swivel bar 106*a* aligns the restrictor 104*a* to a position blocking the full movement of the rod 98. For example, the bias magnet 116 may be mounted directly below or in proximity to the non-firing position of the swivel bar magnet 114*a*. When restrictor 104*a* is in a blocking position for rod 98, hammer rotation and trigger movement are prevented and, accordingly, the weapon cannot be fired. It is noted that magnet 114*a* may be formed of any material in the shape of a suitable housing for supporting a permanently magnetized material contained therein. A side cover 97*a* of the handle frame 99*a* and the other side cover which has been removed to illustrate the safety device of the invention function to prevent the bar 106*a* from pivoting beyond a predetermined arc.

When a magnetic force is brought into proximity with the magnet 114*a*, the swivel bar 106*a* pivots about pin 108*a* moving the restrictor 104*a* out of a conflicting relationship with the shaft or rod 98. Thus, the shaft or rod 98 is slidable in the track 100 directing rod movement approximately along the maximum length of the handle frame 99*a* in response to hammer (not shown) rotation. Accordingly, the weapon 90 can be fired when a magnetic force is in proximity with the magnet 114*a*. If the magnetic force is subsequently removed from proximity with the magnet 114*a*, the biasing means 116 will return bar 106*a* to the preferred conflicting relationship.

Figure 16:
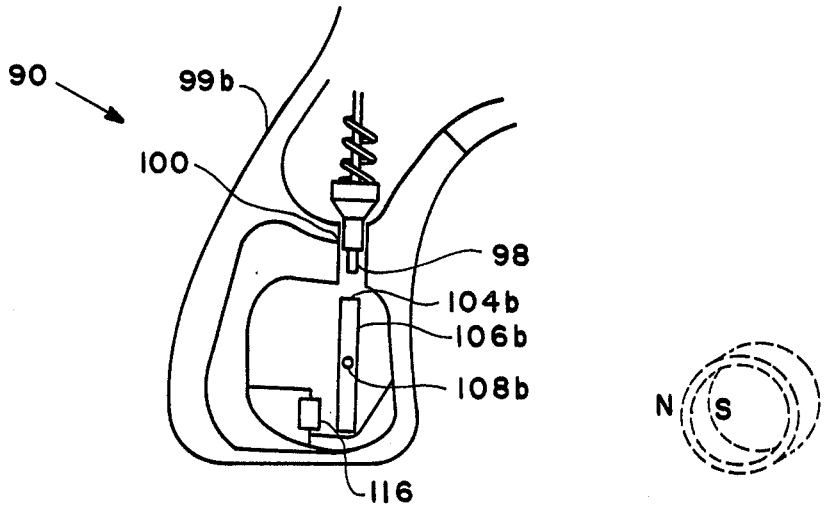

Referring now to Fig. 16, yet another modified version of the embodiment illustrated in FIG. 10 is shown only a portion of a revolver 90 is shown since the revolver is substantially identical with that as shown in FIG. 10. A swivel member bar 106*b* of a magnetically attractable material is located in, and attached to, the handle grip frame 99*b* and pivoted about a point 108*b*, which may or may not be the center point thereof. A restrictor end 104*b* of the swivel bar 106*b* is disposed in conflicting relationship with a shaft or rod 98. The end 104*b* of the swivel bar 106*b* is held in a conflicting relationship with the rod 98 by a biasing means 116 located in proximity to an end of the swivel bar opposite the restrictor end 104*b*. However, the biasing means 116 may be disposed near the restrictor end 104*b*. The biasing means 116 as illustrated is a magnet polarized to repel the swivel bar 106*b* so as to maintain end 104*b* in conflicting relationship with the rod 98. The handle grip frame 99*b* functions to prevent the member 106*b* from pivoting beyond a predetermined arc. The swivel bar 106*b* may be formed of any material in the shape of a suitable housing for supporting a permanently magnetized material contained therein. When a magnetic force is brought into proximity with handle grip housing 99*b* the swivel bar 106*b* will pivot about the point 108*b* moving the restrictor 104*b* out of conflicting relationship with the shaft or rod 98. Thus, the bar or rod 98 is slidable in a track 100 directing rod movement approximately along the length of the handle frame 99*b* in response to hammer (not shown) rotation. Accordingly, the weapon 90 can be fired when a magnetic force is in proximity with the magnet 114*a*. If the magnetic force is subsequently removed from proximity with member 106*b*, the biasing means 116 will cause restrictor end 104*b* to return to the preferred conflicting relationship.

Figure 17:
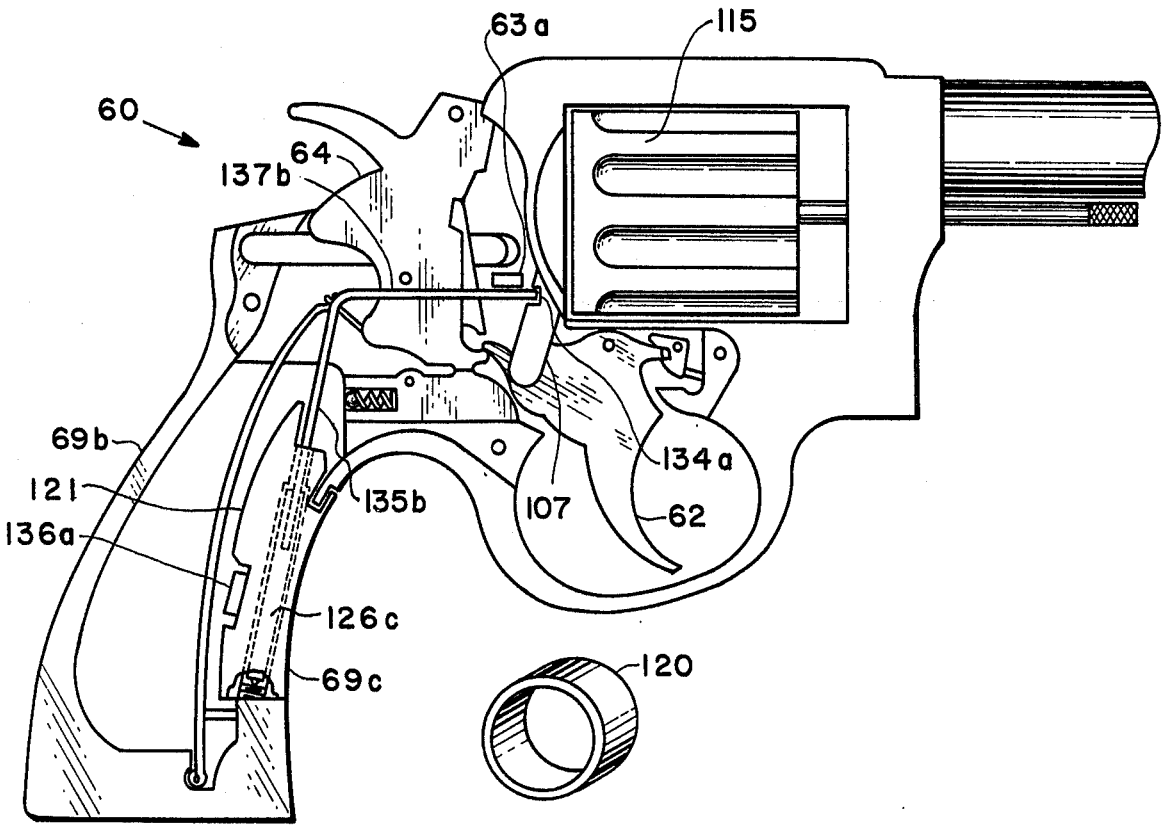
FIG. 17 illustrates another side elevation view of the present invention employing a revolver incorporating the safety device of the present invention.

Referring now to FIG. 17, another modified version of the embodiment illustrated in FIG. 11, is shown as being incorporated in a revolver 60. Wherein a magnetically actuable member 126*c* having an extension arm 135*b* thereof is disposed in a handle grip frame 69*b* of the revolver 60. In this embodiment the extension arm 135*b* of member 126*c* extends through the handle grip frame 69*b* with a restrictor portion 137*b* of the arm 135*b* being disposed in a conflicting relationship with a notch 134*a* in the cylinder rotation linkage member 107 coupled to trigger 62. A backstop or support member 63a, mounted in revolver 60, which normally has a flat surface, is disposed in close proximity to restrictor 137b of the extension 135b to reinforce the restrictor when engaged in the notch 63a and when the linkage member 107 is moved or attempted to be moved in response to pressure applied to the trigger 62. Sides of the revolver frame (not shown) function to prevent the restrictor portion 137b of extension 135b from movement beyond a predetermined arc.

The magnetically actuable member 126c is pivotable or rotatable in substantially the same manner as that in FIG. 11 described hereinabove. A biasing means 136a may be disposed in the body 121 to bias the restrictor 137b of the extension 135b of the magnetically actuable member 126c in a preferred conflicting position. It is noted that bias means 136a may comprise a magnet located in any suitable position, for example, such as along an edge of a magnetically non-attractable handle grip frame 69c, so as to maintain the restrictor 137b in the preferred conflicting relationship.

In normal operation, when pressure is applied to the trigger 62, the cylinder rotation linkage 107 is moved so as to engage projections (not shown) on an end of the cylinder 115 to thereby rotate the cylinder placing the next cartridge in a firing position. Simultaneously, in normal operation, movement of the trigger 62 causes the hammer 64 to rotate in a backward direction thereby cocking the weapon. When bias means 136a, in the embodiment illustrated, acts on the magnetically actuable member 126c so as to position the restrictor 137b of the extension 135b of the member 126c in the slot 134a of the linkage 107, the restrictor 137b prevents the linkage member 107 from moving in response to pressure applied to the trigger 62. Accordingly, cylinder 115 will not rotate and the hammer 64 will also not move sufficiently in response to pressure applied to the trigger 62, and hence, the weapon employing this invention is not operable by trigger movement.

In accordance with the present invention, when an external magnet 120, which may be contained in a ring, is brought into close proximity with edge 69c of the handle grip frame the magnet 120 overcomes the magnetic biasing forces of the biasing magnet 136a and the magnetic forces thereof will cause the portion 137b to rotate out of conflicting relationship with notch 134a of the cylinder movement linkage member 107. Thus, the linkage 107 is free to move, as is the cylinder 115, and as is the hammer, in response to pressure applied to the trigger 62 and the weapon can then be fired. If magnet 120 is subsequently removed from proximity with the member 126c, the biasing means 136a will return the member 126c to the preferred conflicting relationship.

It is noted, a spring or hairspring, or the like may be employed to maintain the restrictor in blocking position or in the conflicting relationship with movable parts of the revolver 60. If such spring is employed to maintain or bias the restrictor in a conflicting relationship with the movable part of the revolver the spring, or the like, preferably would be in contact with the magnetically actuable member or the restrictor.

Figure 17A:
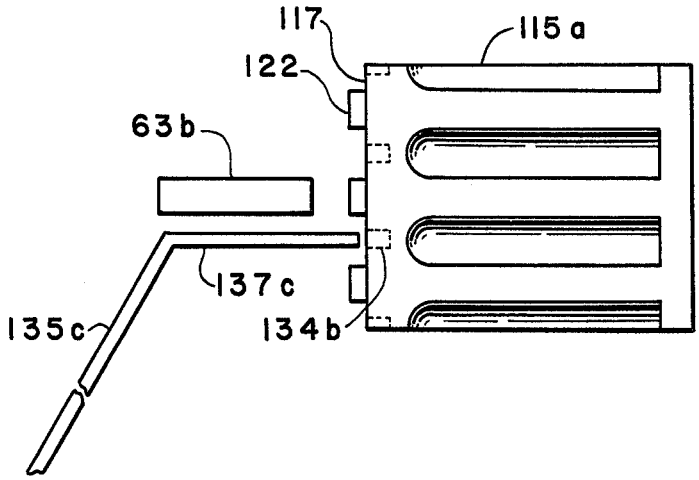
FIG. 17*a* illustrates an alternate form of the embodiment shown in FIG. 17.

Referring now to FIG. 17a another version of the embodiment illustrated in FIG. 17 and described in detail hereinabove is shown. Briefly, only the revolver cylinder 115a and a portion of the embodiment of the present invention is shown since the revolver and the version of this embodiment is substantially similar to that shown in FIG. 17. In this version, a restrictor portion 137c of an extension 135c is disposed in the path of rotation of projections 122 on an end of the cylinder 115a. In normal operation when pressure is applied to the trigger (not shown) the cylinder rotation linkage (not shown) engages a projection 122 on the end 117 of the cylinder 115a to thereby rotate the cylinder. In this embodiment, support member 63b, mounted in the revolver (not shown) reinforces the restrictor 137c conflicting with the cylinder rotation linkage member (not shown) when pressure is applied, such as from an attempted rotation of the cylinder 115a as a function of pressure being applied to the trigger (not shown). Accordingly, the weapon employing this invention is not operable by trigger movement.

Alternatively, a notch or notches 134b (shown in phantom lines) may be formed in an end 117 of the cylinder 115a. In the alternative embodiment, the restrictor extension portion 137c is constructed so as to be long enough to engage within the notch 134b to thereby inhibit movement of the cylinder 115a. The operation of this alternate embodiment is identical to that as described hereinabove.

Figure 18:
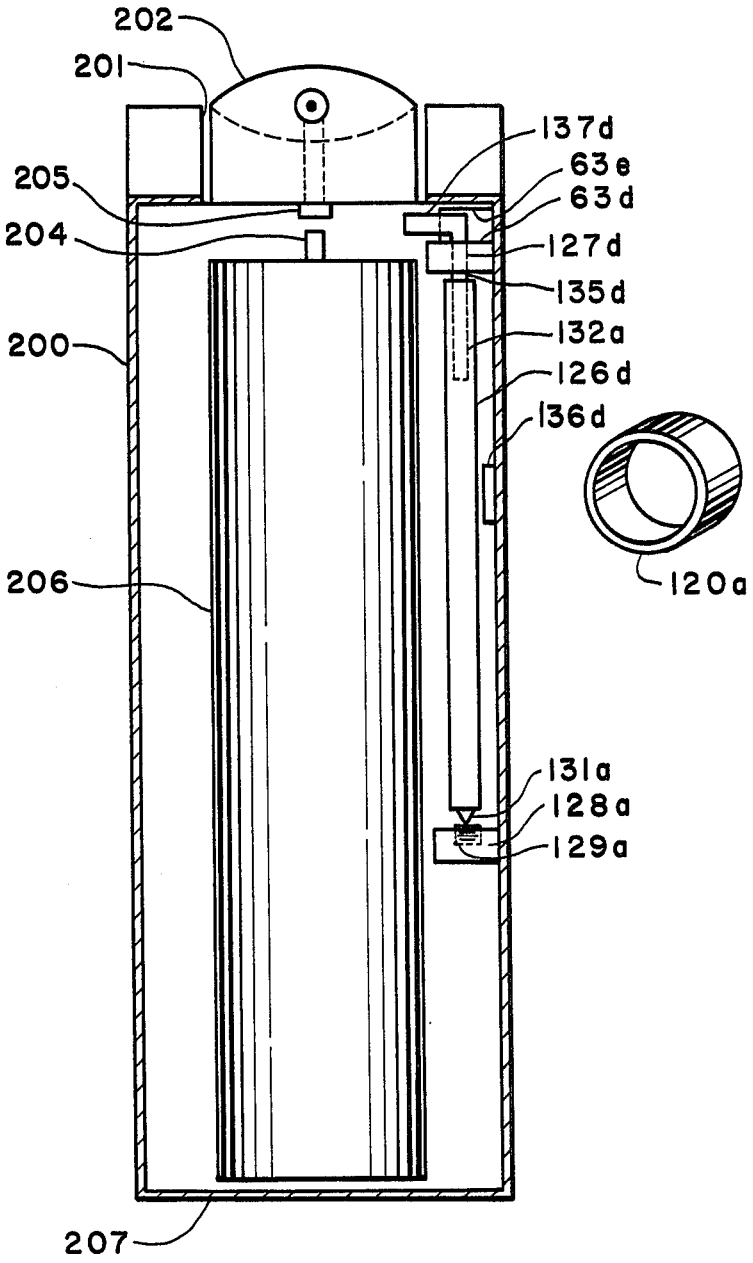
FIG. 18 illustrates the present invention employed in a touch-actuable pressurized container.

Referring now to FIG. 18, the present invention is illustrated as being employed in a touch-operable pressurized container 200. Container 200 may, for example, comprise any of the familiar pressurized containers such as pressurized tear gas can or the like. The contents of the pressurized container 200 are released therefrom by applying pressure to a touch operable member or button 202. The button 202 has a portion 205 and when pressed, the portion 205 engages a nozzle 204 of a retaining tank 206. Both the container 200 and the tank 206 are preferably constructed of non-ferruginous (non-magnetic) material, such as aluminum, plastic, or the like.

In accordance with the embodiment of the present invention illustrated in FIG. 18, a pivoting or rotating member 126d formed from a magnetically-actuable material is disposed between the container 200 and the tank 206. The member 126d has a point or conical-shaped end 131a formed to engage a valley or bearing dimple 129a of a support bracket 128a. The bracket 128a is attached to the container 200 to support and maintain one end of the member 126d, the bracket is disposed in the container so as to allow member 126d to be disposed substantially parallel to the wall of the container. The opposite end of the member 126d has a channel opening 132a formed therein. A restraining member 135d having confronting type head restrictor 137d on one end thereof is formed so as to be received by a channel 132a of the member 126d. The restraining member 135d frictionally engages or is permanently secured into the channel 132a of the member 126d and in particular, passes through the channel 127d of a support member 63d. The support member 63d has the restraining member 135d passing through channel 127d thereof is mounted to the wall of the container 200, thereby retaining member 126d running longitudinally parallel to the container wall when the bearing 129a of support bracket 128a has the end 131a of member 126d disposed therein. Thus, the combination of support member 63d, the support bracket 128a, the member 126d and the member 135d form an assembly comprising the safety-device mechanism of this embodiment.

A biasing means 136d is provided near the magnetically actuable member 126d and adjacent the container 200 so as to maintain a preferred orientation of the members 126d and 135d when disposed in the bearing 129a and in the channel opening 127d respectively.

In this embodiment the safety-device is incorporated in container 200. A button 202 within the container 200 is normally able to move along a track 201 in response to pressure applied to button 202. Full movement of the button 202 causes portion 205 thereof to depress the nozzle 204 to discharge the propellent from the tank 206. However, the confronting head restrictor 137d of the restraining member 135d is disposed in a conflicting relationship with button 202 to thereby inhibit movement of the button, preventing the nozzle 204 from being depressed, thus preventing discharge of the vaporized propellent or pressurized liquid in tank 206.

The safety restrictor 137d may be oriented in a number of ways to accomplish the result of inhibiting movement of the button 202. However, it is preferable to orient the confronting head restrictor 137d directed as illustrated with support member 63d also functioning to reinforce the restrictor head 137d when in a blocking position to prevent sufficient movement of button 202 to depress nozzle 204. When a magnetic force, such as from a magnetic ring 120a is brought in proximity to the magnetically actuable member 126d, the restrictor type head 137d is rotated out of the path of the button 202, thus permitting movement of the button along the track 201, thereby permitting sufficient movement of the portion 205 of the button to depress nozzle 204 so that the propellent in the tank 206 is discharged. Also, the raised walls 63e of support member 63d function to prevent the restrictor 137d of member 135d from pivoting beyond a predetermined arc. If the magnetic ring 120a is subsequently removed from proximity with the member 126d, the biasing means 136d will cause the return of the restrictor 137d to the preferred conflicting relationship. Alternatively, a spring or the like may be employed to maintain the restrictor 137d in a blocking position.

Since the container 200 with the attached safety-device will be the most expensive part of this embodiment a removable cap may be employed on the bottom 207 to allow removal of the tank 206 once the propellent has been expended and the tank repressurized or another similar charged tank to be replaced in the container 200.

The subject invention provides a simple device which acts as a safety feature in the use of firearms or other touch actuated devices. It is particularly useful to prevent unauthorized or accidental discharge of the firearm. This includes children and accidents such as having a shotgun fall from being propped against a tree. Law enforcement officers, who carry weapons normally loaded, are protected from having the weapon taken from them and fired at them by employing the subject device. Also, accidental firing is inhibited since the hammer actuation means is inhibited from operating by the safety device of the present invention. Other advantages with law enforcement officers is the elimination of setting the safety catch, since the pistol is normally carried loaded. The subject invention also eliminates the time required to remove the safety, so that the officer may act more rapidly. Also, accidents and injuries by unauthorized operation of touch operable devices, such as pressurized containers, power tools or the like are thereby reduced.

The foregoing is considered to have shown and described preferred embodiments of this invention, it being understood that numerous modifications and changes in details of construction, combination and arrangement can be resorted to by those skilled in the art without departing from the scope of the invention as claimed. It is noted other embodiments include, but are not limited to, inhibiting triggers on power tools, opening caps of bottles, opening lids of containers, operation of switches and the like.

I claim:

1. In a safety device for preventing the unauthorized firing of a weapon having a trigger, a cylinder for holding cartridges to be fired by said weapon, a cylinder rotation means operative in response to movement of said trigger, a hammer, and hammer actuation means, wherein the invention comprises:
   - a magnetic actuable member pivotally mounted with respect to said cylinder rotating means;
   - stop means for preventing said member from pivoting beyond a predetermined arc; and
   - bias means for maintaining said member in a position of the arc for preventing movement of said cylinder rotation means to thereby prevent firing of said weapon.

2. A safety device as in claim 1 further characterized by said cylinder rotating means comprising a linkage mechanically coupled between said trigger and said cylinder and having a notch formed therein and said magnetically actuable member having an extension thereof for engaging the notch in said linkage.

3. A safety device as in claim 1 further characterized by said cylinder having a plurality of projections on one end thereof, and said magnetically actuable member being disposed for interfering with said projections on said cylinder to thereby prevent rotation of the said cylinder.

4. A safety device as in claim 1 further characterized by said cylinder including a plurality of notches formed in one end thereof, and said magnetically actuable member being disposed for engaging said notches so as to prevent rotation of said cylinder.

* * * * *